US005893475A

United States Patent [19]

May

[11] Patent Number: 5,893,475

[45] Date of Patent: Apr. 13, 1999

[54] TAMPER PROOF CONTAINER

[75] Inventor: Anthony Gerard May, Russell, Australia

[73] Assignee: Sprintquip NZ Limited, Auckland, New Zealand

[21] Appl. No.: 08/843,655

[22] Filed: Apr. 16, 1997

[51] Int. Cl.[6] ..... B65D 41/34; B65D 55/10

[52] U.S. Cl. ..... 215/252; 215/253; 215/330; 220/214

[58] Field of Search ..... 215/48, 213, 201, 215/250, 253, 330, 901, 221, 273, 230, 252; 270/214, 265, 266, 315, 324, 346, 351, DIG. 20; 206/459.1

[56] References Cited

U.S. PATENT DOCUMENTS

| | | | |
|---|---|---|---|
| 4,778,070 | 10/1988 | Walker | 215/48 X |
| 4,782,977 | 11/1988 | Watanabe et al. | 220/324 |
| 4,934,547 | 6/1990 | Mayes et al. | 220/214 X |
| 4,989,739 | 2/1991 | Falcone et al. | 215/221 |
| 5,133,470 | 7/1992 | Abrams et al. | 215/250 |
| 5,238,134 | 8/1993 | Knapp | 220/265 X |
| 5,427,260 | 6/1995 | Mueller et al. | 220/214 X |
| 5,678,719 | 10/1997 | Adams et al. | 215/253 X |

FOREIGN PATENT DOCUMENTS

| | | | |
|---|---|---|---|
| 648044 | 4/1991 | Australia | 220/265 |
| 384135 | 8/1990 | European Pat. Off. | 215/250 |
| 1562178 | 2/1969 | France | 215/250 |

*Primary Examiner*—Stephen K. Cronin
*Assistant Examiner*—Nathan Newhouse
*Attorney, Agent, or Firm*—Merchant, Gould, Smith, Edell, Welter & Schmidt, P.A.

[57] ABSTRACT

A tamperproof container 1 has a main body portion 2 with an opening 3 and a closure 4. The closure 4 is releasably engageable with the neck portion 5 of the body portion 1. One or more tamperproof indicators 10 have leg portions 11 engageable within respective of apertures 12 around a peripheral ledge 13 of the closure 4. Rotation of the closure 4 relative to the neck 5 will result in the legs 11 engaging with a respective abutment 15 provided on a shoulder 14 of the body portion 2 breaking off the legs 11 and showing that the closure 4 has been removed or an attempt to do so has been made.

7 Claims, 4 Drawing Sheets

TAMPER PROOF CONTAINER

BACKGROUND (1) Field of the Invention

This invention relates to a container and, in particular, a tamper proof container. Further, the invention is directed to a method of providing such a container.

(2) Description of the Prior Art

A number of tamper proof containers already exist in the marketplace. Typical examples are the tamper proof containers which provide a tear-off or detachable portion on the lid of the container so that the portion must attach to unscrew the top of the container.

Although such containers are suitable for use on disposable containers, they are less satisfactory for containers requiring reuse.

If it is desired to reuse the container and place the container in a state whereby subsequent tampering can be indicated, it is necessary to replace the entire lid or top of the container or bottle. Such containers do not provide the ability for the tamperproof indicating strip or portion to be replaced on its own so that the lid or top can be reused and the container resealed.

Another problem with containers such as the general type made from moulded plastics material is the difficulty in stacking such items. Often such containers lack the strength in the walls of the container to facilitate the container being laid on its side and stacked one on top of the other.

OBJECT OF THE INVENTION

Therefore, it is an object of the present invention to provide a container and/or a method of producing a container or tamperproof seal which overcomes some of the disadvantages of the prior art or at least provides the public with a useful choice.

SUMMARY OF THE INVENTION

Accordingly, in a first aspect, the invention may broadly be said to consist in a container comprising:

a main body portion;

an opening into said main body portion;

a closure member adopted to close by way of rotational engagement with the main body portion said opening into said main body portion; and a tamperproof indicating means engageable with said closure member such that once engaged, said closure member cannot be opened without destruction of the integrity of said tamperproof indicating means and further such that a replacement tamperproof indicating means can be engaged with said closure member upon reclosing of the container, and in which the tamperproof indicating means when engaged abuts the closure member and the main body portion of the container.

Accordingly, in a second aspect, the invention may broadly be said to consist in a container comprising:

a main body portion substantially in the shape of a rectangular prism;

an opening into said main body portion;

a closure member to close said opening; and a plurality of circumferential ribs about the circumference of said main body portion to strengthen sides of said main body portion such that said container may be laid on its side and stacked.

BRIEF DESCRIPTION OF THE DRAWINGS

The invention will now be described with reference to the following drawings in which.

DETAILED DESCRIPTION OF PREFERRED EMBODIMENTS

Figure 1:
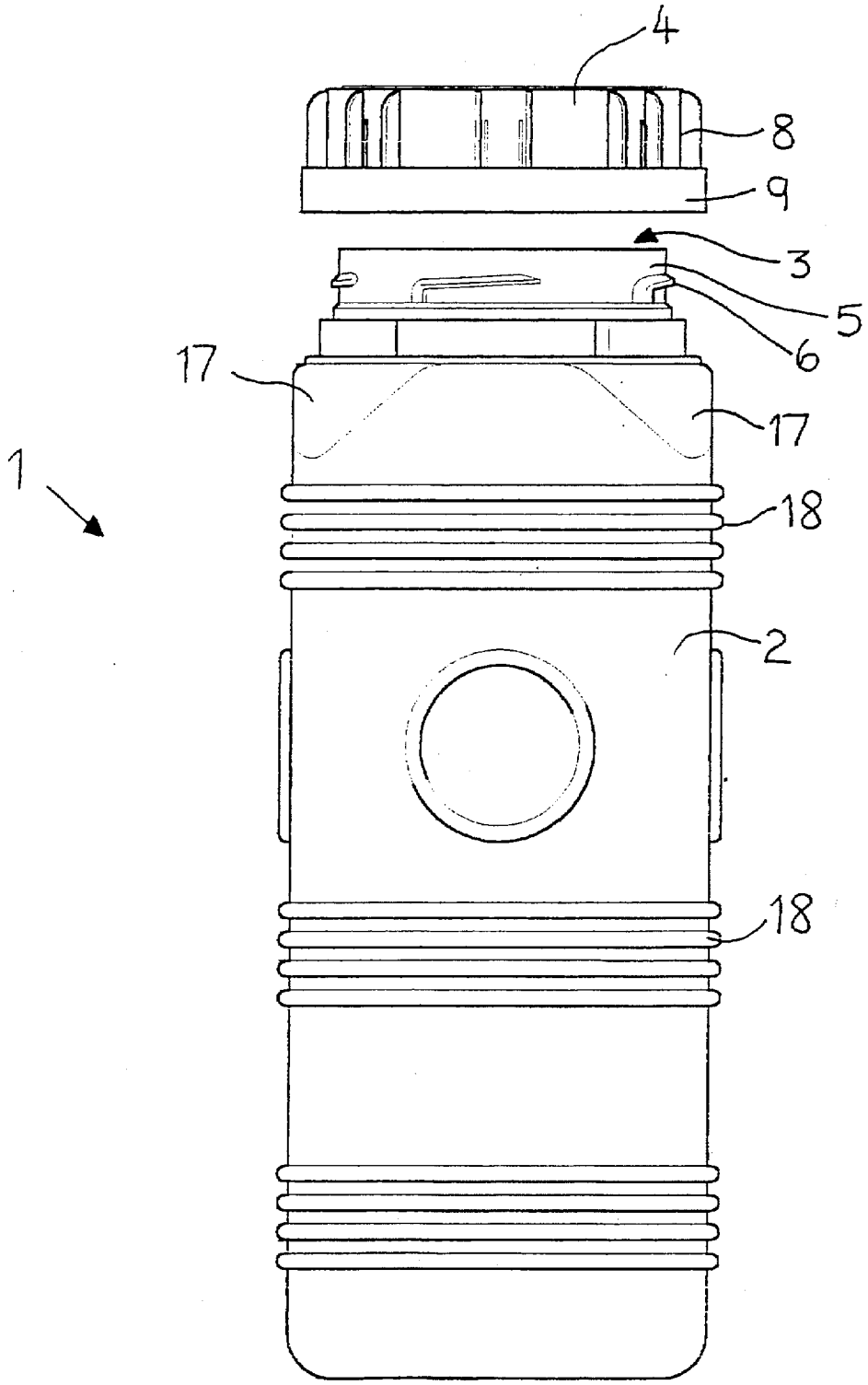
FIG. 1: Shows an exploded front elevation of a container in accordance with one embodiment of the invention.
Figure 2:
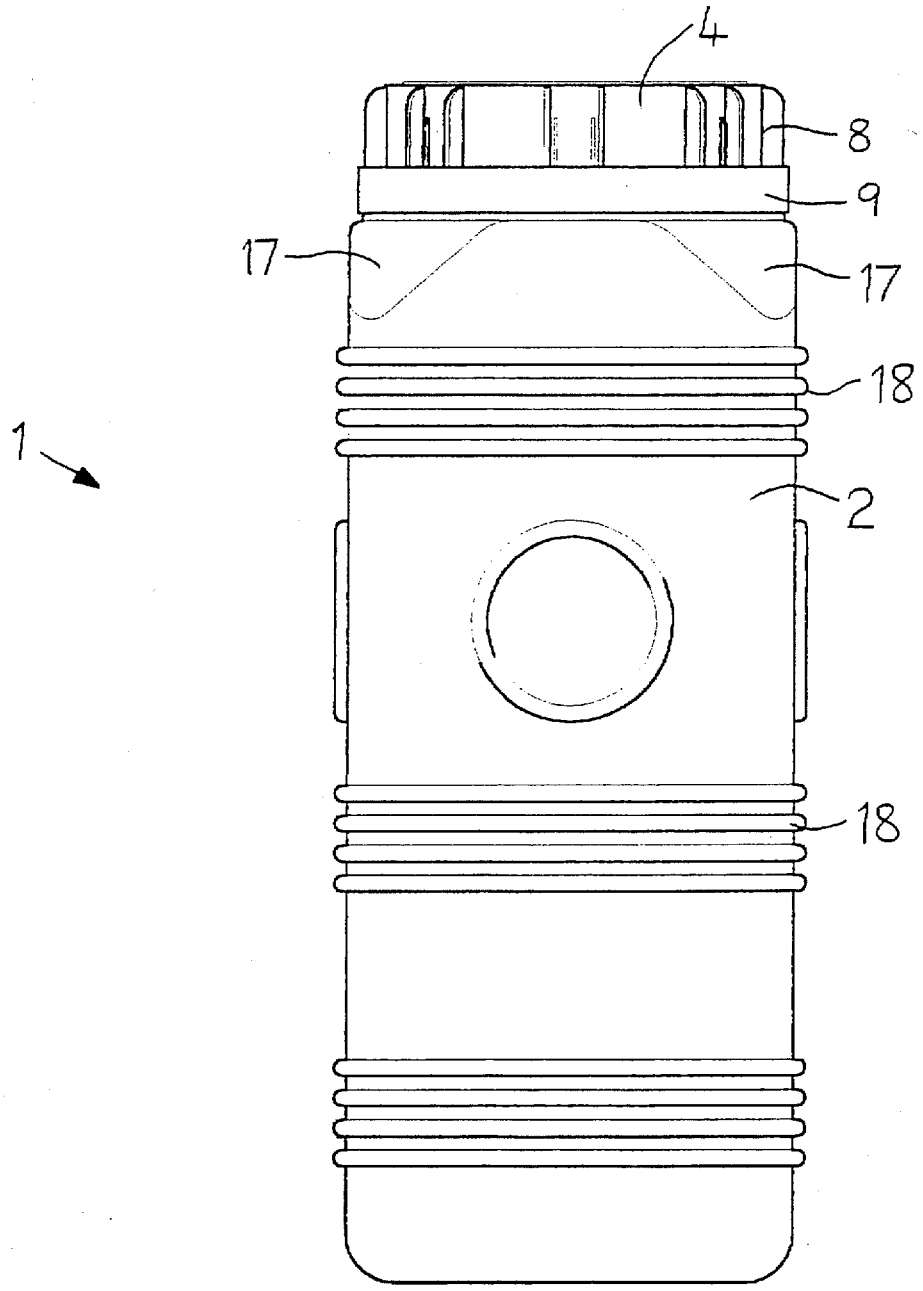
FIG. 2: Shows a front elevation of the apparatus of FIG. 1.

Referring to the drawings, the invention can be seen to comprise a container 1 having a main body portion 2, an opening into the main body portion 3 and a closure 4 to close the opening 3. Although the container 1 can be of a number of general forms and shapes, this preferred embodiment shows the main body portion 2 being provided as a substantially rectangular prism with the opening 3 and closure 4 at one end of the main body portion 2. Generally this will be the top of the container 1.

The container 1 may be made from a wide variety of materials including plastics materials. In the preferred form, a common plastic such as polyethylene may be used. Further, the container may be formed in a variety of manners such as blowmoulding, injection moulding or parts of the container may be made by different methods.

Turning specifically to FIG. 1, it can be seen that the opening 3 is surrounded by a neck portion 5 having engagement means 6 to cooperate with cooperating engaging means 7 on the inside of the closure 4. Again, in this preferred form, a threaded form of closure is provided with the engagement means 7 being projections on the inside of a downwardly extending flange 8 on the closure 4 and projections 6 being provided on the neck 5 to engage over the corresponding projection on the closure 4. Although this preferred form provides the threaded engagements 6 and 7, a bayonet fitting or other alternative engagements may be utilised although it is preferred that the engagement means between the neck and the closure 4 are such that rotational engagement and disengagement of the closure is provided.

Figure 3:
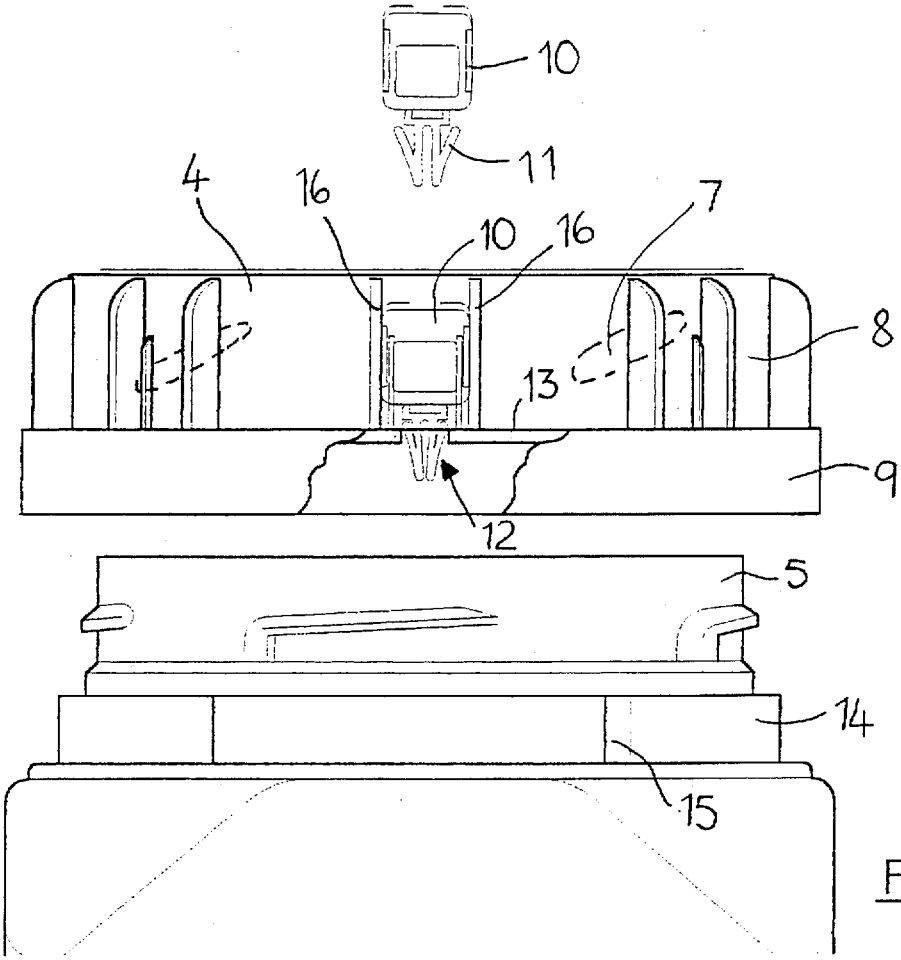
FIG. 3: Shows an elevation of part of the apparatus of FIG. 1 including a partial cross-section.

The closure member 4 and container main body portion 2 engage with a tamperproof indicating means 10 as shown particularly in FIG. 3. In FIG. 3 the tamperproof indicating means 10 is shown both separate from the closure 4 and also in a position partway engaged with the closure 4.

The tamperproof indicating means 10 engages with the closure 4 and has a portion 11 to resist withdrawal from the closure 4 once fitted. Again, in this preferred form only, this is provided as downwardly depending legs 11 which may be compressed to be forced through an aperture 12 in a ledge 13 of the closure 4 at which time the legs 11 will again expand to engage in underside surface of the ledge 13 provided between the downwardly dependent flange 8 and a further downwardly dependent flange 9.

Figure 4:
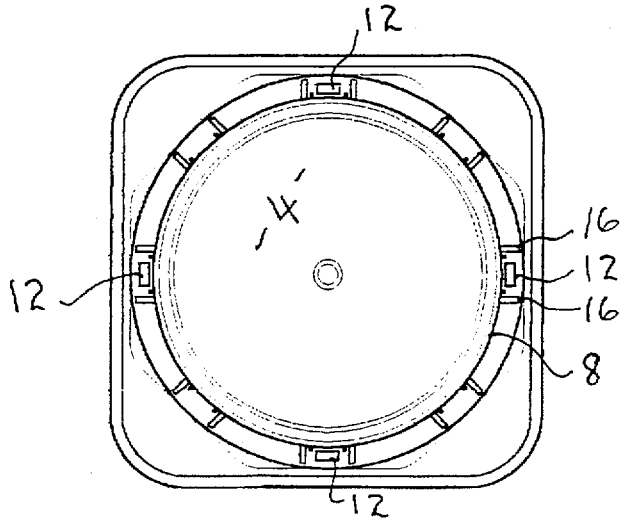
FIG. 4: Shows a plan view of the apparatus arranged in accordance with FIG. 2.

As seen in FIG. 4, the ledge 13 may have a plurality of apertures 12 so that one or more indicators 10 may be engaged in a respective aperture 12 at any one time although only a single indicator 10 in one of the apertures 12 would normally be used.

Referring to FIG. 3, it can be seen that the container also provides a shoulder portion 14 adjacent the neck portion 5. This shoulder portion 14 will be covered in use by the downwardly dependent flange 9 and contain abutment portions 15.

Figure 5:
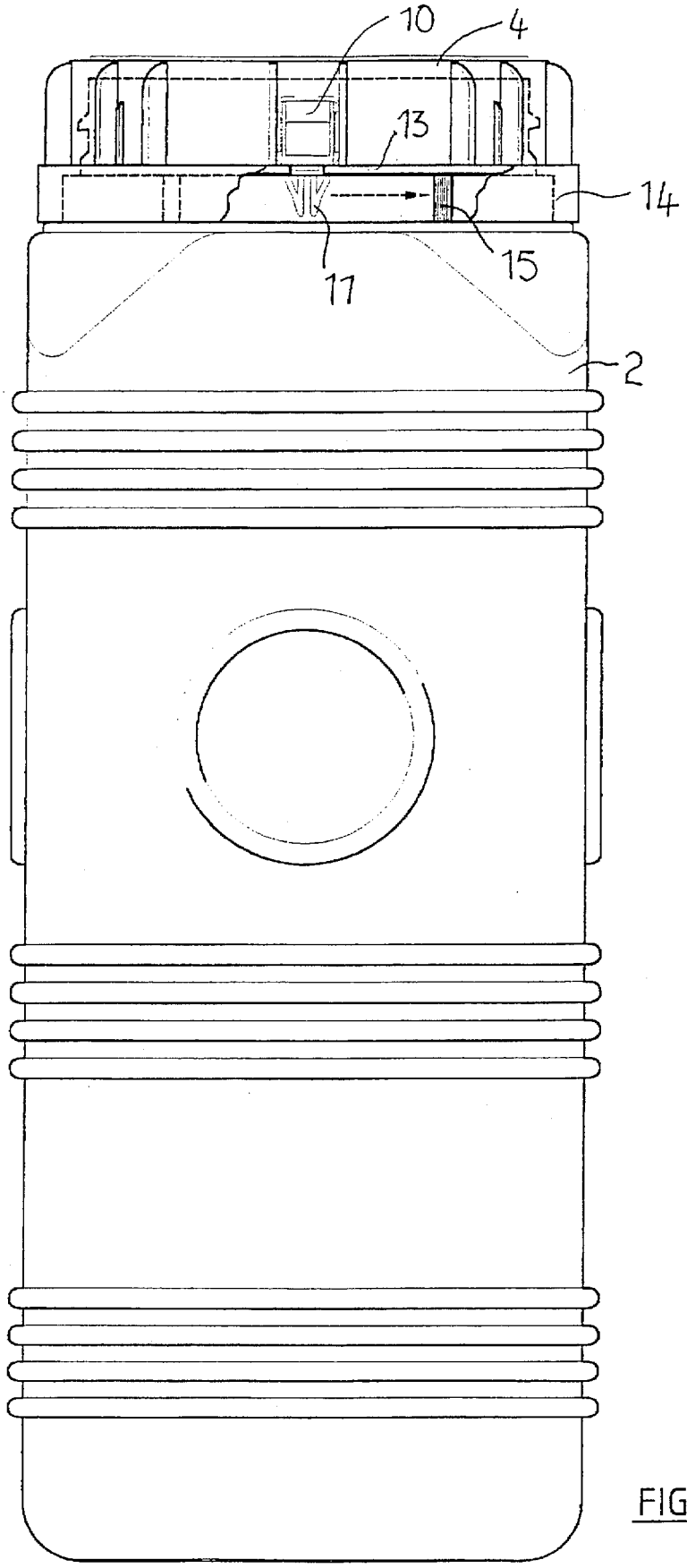
FIG. 5: Shows an elevation of the apparatus in accordance with FIG. 2 with a partial cross-section in the region of the closure.

Turning to FIG. 5, it can be seen that one of the tamperproof indicating means 10 is engaged with the closure 4 in a position such that rotational movement of the closure 4 with respect to the main body portion 2 will cause the portions 11 beneath the ledge 13 to move towards and abut the respective abutment 15 on the shoulder 14. The correct positioning of at least one such tamperproof indicating means 10 can allow the tamperproof indicating means to resist the rotation of movement of the closure 4 against the main body portion 2 that is required to allow cooperating engagements 6 and 7 to disengage and allow access to the container.

Therefore, once the tamperproof indicating means 10 is provided in the slot 12 to engage with the closure 4, the closure 4 can only be removed upon destruction of the integrity of the tamperproof indicating means 10 namely the breaking off of the legs 11. If sufficient force is applied to rotate the closure 4 with respect to the main body portion 2, the portions 11 will be broken off against the abutment 15 to indicate the container has been opened. The indicating means 10 cannot be simply removed from the closure 4 through upward movement to disengage the portion 11 with the flange 13 due to the engagement of the portion 11 either side of the opening 12 into the flange 13.

Although this preferred form provides the abutments 15 on a shoulder portion 14 separated from the neck 5 providing the main engagement between the closure 4 and the container 2, other arrangements are possible to provide a similar form of tamperproof indicating means whereupon rotation of the closure 4 causes destruction of all or part of the tamperproof indicating means.

Referring to FIGS. 3 and 4, it can be seen that the tamperproof indicating means 10 may be sized to slide between the flange 8 and guides 16 provided on the outside of the flange 8.

By providing the tamperproof indicating means 10 as a discrete member separately engageable with the closure 4 and a main body portion 2, opening of the container causing destruction of the integrity of the tamperproof indicating means can be done when permissible and the tamperproof indicating means simply replaced without the need to replace the entire closure or container. This provides particular advantages in uses such as that to which the preferred form is put being used as a container for carrying coin in cash handling situations. The overall container and the closure 4 may be expensive if provided for only a one time use and this preferred form of the invention allows reuse of the items other than the engageable tamperproof indicating means 10, simply by providing a supply of the indicators 10.

The main body portion 2 in this preferred form is shown as a substantially rectangular prism although some variation such as sloping shoulder portions 17 can easily be accommodated. A plurality of circumferential ribs 18 may be provided around the circumference of the main body portion 2. Such ribs 18 allow additional strength in the side walls of the main body portion 2 such that the container may be laid on its side and one container stacked upon the other. The ribs 18 both provide additional strength to the side walls to accommodate such stacking and may also provide some form of engagement between adjacent containers to inhibit relative movement.

Where in the foregoing description reference has been made to specific components or integers of the invention having known equivalents then such equivalents are herein incorporated as if individually set forth.

Although this invention has been described by way of example and with reference to possible embodiments thereof it is to be understood that modifications or improvements may be made thereto without departing from the scope of the invention as defined in the appended claims.

I claim:

1. A container comprising:

a main body portion having threads;

an opening into said main body portion;

a closure member having threads adapted to close, by way of rotational engagement of the threads of the closure member with the threads of the main body portion, said opening into said main body portion; and a tamperproof indicating means engageable with said closure member such that once engaged, said closure member cannot be opened without destruction of the integrity of said tamperproof indicating means and further such that a replacement said tamperproof indicating means can be engaged with said closure member upon reclosing of the container, and in which the tamperproof indicating means when engaged abuts the closure member and the main body portion of the container.

2. A container as claimed in claim 1 wherein said tamperproof indicating means includes a portion which is broken off from the remainder of said tamperproof indicating means to enable opening of said closure member, said destruction of the integrity of said tamperproof indicating means leaving said body portion and said closure member intact for reuse.

3. A container as claimed in claim 2 wherein said tamperproof indicating portion is engageable with said closure member and further engages said main body portion to resist rotation of said closure member with respect to said main body portion.

4. A container as claimed in claim 3 wherein said tamperproof indicating portion engages said closure member through an aperture in said closure member.

5. A container as claimed in claim 4 wherein a plurality of said apertures are provided in said closure member each of which is able to accommodate a respective tamperproof indicating means.

6. A container as claimed in claim 4 wherein said tamperproof indicating portion engages through said aperture in said closure member and includes expandable engaging portions to expand after said tamperproof indicating portion has been placed through said aperture and which resist withdrawal of said tamperproof indicating portion without destruction.

7. A container as claimed in claim 6 wherein said tamperproof indicating portion engages said main body portion by abutting an abutment provided on or adjacent a neck of said main body portion.

* * * * *